US006553913B1

(12) United States Patent
Wardlaw

(10) Patent No.: US 6,553,913 B1
(45) Date of Patent: Apr. 29, 2003

(54) PROJECTILE AND WEAPON SYSTEM PROVIDING VARIABLE LETHALITY

(75) Inventor: Michael J. Wardlaw, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 2 days.

(21) Appl. No.: 09/826,401

(22) Filed: Apr. 3, 2001

(51) Int. Cl.[7] ..... F42B 12/02

(52) U.S. Cl. ..... 102/501; 102/502; 102/517; 89/1.11

(58) Field of Search ..... 102/501, 502, 102/513–517, 529, 395, 498; 89/1.11

(56) References Cited

U.S. PATENT DOCUMENTS

| | | | | |
|---|---|---|---|---|
| 1,284,155 | A | 11/1918 | Shartzer | |
| 1,987,912 | A | 1/1935 | Rady et al. | 42/84 |
| 2,942,603 | A | 6/1960 | Geyer | 128/235 |
| 3,229,402 | A | 1/1966 | Thacker | 42/79 |
| 3,733,727 | A | 5/1973 | Jones et al. | 42/1 R |
| 3,906,859 | A | 9/1975 | Smith | 102/41 |
| 4,656,946 | A | 4/1987 | Gordan et al. | 102/438 |
| 4,713,904 | A | 12/1987 | Anderson et al. | 42/79 |
| 4,833,961 | A | 5/1989 | Adini | 89/1.1 |
| 4,942,818 | A | 7/1990 | Saxby | 102/444 |
| 4,981,286 | A | 1/1991 | Kato et al. | 267/140.1 |
| 5,014,829 | A | 5/1991 | Hare, Sr. | 188/267 |
| 5,290,821 | A | 3/1994 | Sakurai et al. | 521/82 |
| 5,450,795 | A | 9/1995 | Adelman | 102/444 |
| 5,549,837 | A | 8/1996 | Ginder et al. | 252/62.52 |
| 5,665,808 | A | 9/1997 | Bilsbury et al. | 524/439 |
| 5,698,815 | A | 12/1997 | Ragner | 102/502 |
| 6,298,841 | B1 * | 10/2001 | Cheng et al. | 102/501 |

FOREIGN PATENT DOCUMENTS

GB 2274851 * 8/1994

OTHER PUBLICATIONS

ALS Technologies, "Less Lethal Direct Impact Munitions".

* cited by examiner

*Primary Examiner*—Harold J. Tudor
(74) *Attorney, Agent, or Firm*—Matthew J. Bussan, Esq.; James B. Bechtel, Esq.; Peter J. Van Bergen, Esq.

(57) ABSTRACT

A weapon system and projectile are disclosed. The projectile incorporates a rheological fluid, the viscosity of which is adjustable in the presence of an appropriate field of energy. The weapon system includes a launching device (e.g., a gun) for firing the projectile and an energy field generator coupled to the launching device. The energy field generator provides the appropriate field of energy about the projectile to increase the viscosity of the rheological fluid. The projectile can be non-lethal when the rheological fluid has not been subjected to the field of energy and can be made more lethal when the rheological fluid has been subjected to the field of energy.

35 Claims, 2 Drawing Sheets

FIG.1
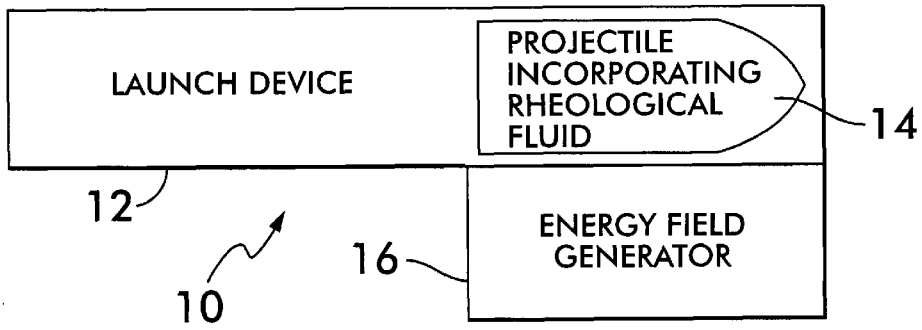
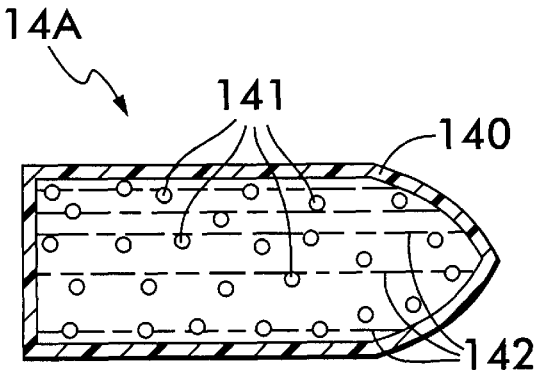
FIG.2
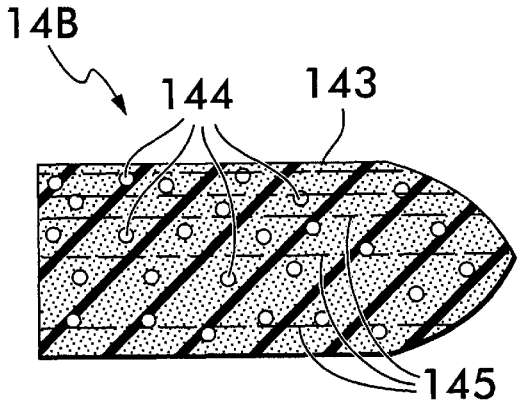
FIG.3
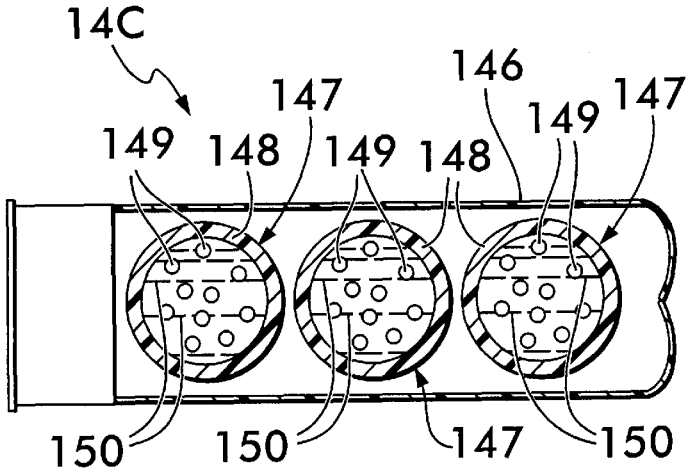
FIG.4

PROJECTILE AND WEAPON SYSTEM PROVIDING VARIABLE LETHALITY

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to non-lethal projectiles and weapon systems, and more particularly to a projectile and weapon system that are adjustable in terms of the lethality thereof.

BACKGROUND OF THE INVENTION

Until recently, any fired weapon (e.g., hand gun, shotgun, rifle, etc.) was considered to be a lethal weapon. That is, the projectiles fired from the weapon were of sufficient size/hardness and were fired at sufficient velocity to render a lethal blow to a target individual. More recently, efforts have been made to produce weapons and/or projectiles that are not meant to kill a target individual. In terms of non-lethal weapons, the weapons are typically designed to fire a projectile at slower speeds to reduce the lethality of the fired projectile. In terms of non-lethal projectiles, a variety of rubber-based projectiles have been developed for use in standard weapons. For example, the rubber material can be formed as the projectile body, as balls or small pellets dispersed from a shotgun shell, or as small pellets contained within a pouch or bag. However, there is currently no projectile that can be used as either a lethal or non-lethal projectile. Further, there is no weapon system that offers the user the ability to adjust the lethality of the weapon by adjusting the lethality of the projectile that is to be fired therefrom.

SUMMARY OF THE INVENTION

Accordingly, it is an object of the present invention to provide projectile and weapon system having a variable lethality.

Another object of the present invention is to provide a projectile and weapon system having a variable lethality that can be changed just prior to the firing thereof.

Still another object of the present invention is to provide a method of changing the lethality of a projectile.

Yet another object of the present invention is to provide a weapon system that can operate over a range of lethality.

A further object of the present invention is to provide a weapon system that can change the lethality of a projectile that is to be fired therefrom.

A still further object of the present invention is to provide a weapon system that can fire lethal and non-lethal projectiles.

Yet another object of the present invention is to provide a weapon system that can make a projectile fired therefrom lethal or non-lethal.

Other objects and advantages of the present invention will become more obvious hereinafter in the specification and drawings.

In accordance with the present invention, a weapon system and projectile are disclosed. The projectile incorporates a rheological fluid. In general, the projectile has a housing defining a shape for a projectile with the rheological fluid being contained within the housing. The rheological fluid is one or more of an electrorheological (ER), magnetorheological (MR) or enhanced-MR fluid. The viscosity of the rheological fluid is adjustable in the presence of an appropriate field of energy. The weapon system includes a launching device (e.g., a gun) for firing the projectile therefrom. An energy field generator, coupled to the launching device, generates the appropriate field of energy about the projectile to change (i.e., increase) the viscosity of the rheological fluid. The projectile is designed such that it is; i) non-lethal when the rheological fluid has not been subjected to the field of energy, and ii) more lethal when the rheological fluid has been subjected to the field of energy.

BRIEF DESCRIPTION OF THE DRAWINGS

FIG. 1 is a top-level schematic diagram of a weapon system that provides variable lethality in accordance with the present invention;

FIG. 2 is a cross-sectional view of one embodiment of a projectile constructed in accordance with the present invention in which a compliant outer casing seals a rheological fluid therein;

FIG. 3 is a cross-sectional view of another embodiment of a projectile in accordance with the present invention in which a compliant absorptive material has absorbed the rheological fluid;

FIG. 4 is a cross-sectional view of another embodiment of a projectile in accordance with the present invention in which a shotgun-type casing houses a plurality of pellets or balls containing a rheological fluid;

DETAILED DESCRIPTION OF THE INVENTION

Figure 5:
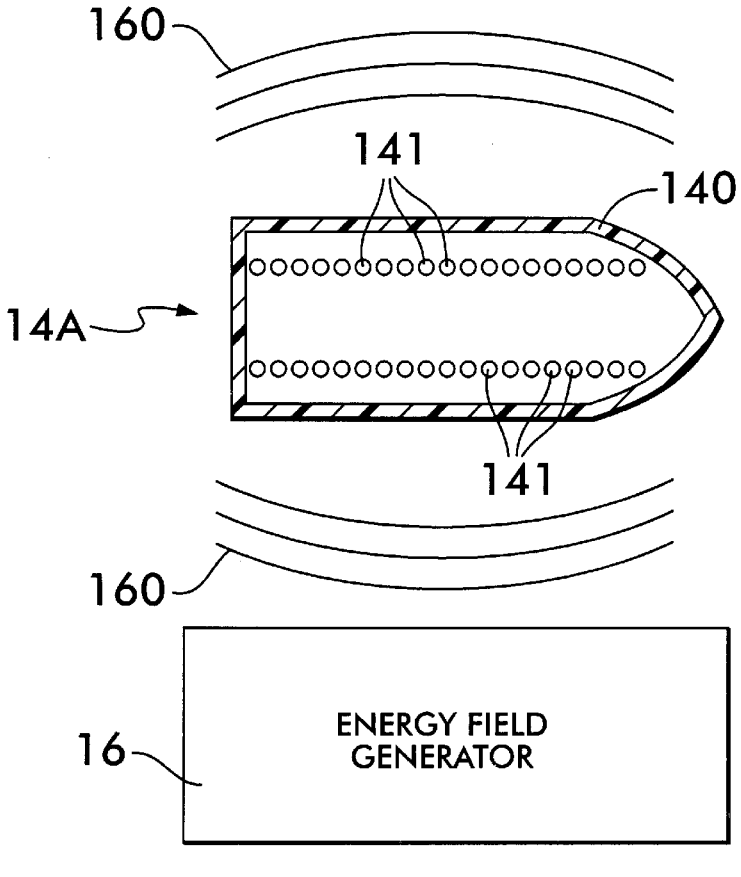
FIG. 5 is a schematic view of the energy field generator and generated energy field depicting how the energy field affects a projectile incorporating a rheological fluid in accordance with the present invention.

Referring now to the drawings, and more particularly to FIG. 1, a weapon system in accordance with the present invention is shown and referenced generally by numeral 10. Weapon system 10 includes a launch device 12, a projectile that incorporates a rheological fluid 14 housed in launch device 12, and an energy field generator 16 coupled to launch device 12. It is to be understood that weapon system 10 can be implemented in a variety of ways without departing from the scope of the present invention. That is, using the teachings described herein, one of ordinary skill in the art in the fields of firearms and ammunition could make a variety of weapons and projectiles falling within the scope of the present invention.

Launch device 12 can be any hand-held gun (e.g., hand gun, rifle, shotgun, etc.) or free-standing gun used to fire projectile 14 therefrom. Launch device 12 "houses" projectile 14 prior to the firing thereof. For purposes of the present invention, the term "houses" is meant to encompass a variety of situations. For example, the term could refer to the barrel of launch device 12 to include any portion thereof from the barrel's breech to muzzle. The term "houses" could also refer to a magazine (coupled to launch device 12) housing a plurality of projectiles 14 therein. Thus, it is to be understood that the present invention is not limited to a particular location of projectile 14 within launch device 12 for proper operation of the present invention.

As mentioned above, projectile 14 incorporates a rheological fluid. Rheological fluids are known in the art as fluids that change (i.e., increase) in viscosity in the presence of an appropriate field of energy. In general, rheological fluids comprise a fluid carrier medium having solid particles mixed therein. In the presence of an appropriate energy field, the solid particles in rheological fluids move into alignment. More specifically, rheological fluids respond by forming fibrous structures parallel to the applied field. When this alignment occurs, the ability of the fluid to flow is substantially decreased as the formation of these fibrous structures triggers a significant increase (e.g., by factors as high as 100,000) in the viscosity of the fluid. This phenomenon has been observed to occur in the presence of both magnetic fields and electrical fields resulting in the terminology "electrorheological fluid" (ER fluid) and "magnetorheological fluid" (MR fluid). In general, ER fluids make use of solid particles that are responsive to (i.e., manipulated by) an electric field whereas MR fluids make use of solid particles that are magnetizable.

In terms of ER fluids, it is well known that certain fluids respond to the influence of an electric potential by evidencing a rapid and pronounced increase in viscosity and an increased resistance to shear. Such ER fluids comprise slurries of finely divided hydrophilic solids in hydrophobic liquids. In the absence of an electric field, these fluids behave in a Newtonian fashion. However, when an electric field is applied, the fluids become proportionately more viscous as the potential of the electric field increases. In strong electric fields, the fluids can thicken into a solid. The electro-rheological phenomenon reverses when the electric potential is removed, and the material returns to its fluid state.

Electro-rheological fluids change their state very rapidly when electric fields are present, with typical response times being on the order of one millisecond. The more viscous state can be maintained even after the electric field is no longer present. The time period for maintenance of the more viscous state will vary. However, in general, the viscous state can be maintained for a period of several seconds after the electric field is no longer present.

In terms of MR fluids, the basis for the magnetorheological effect can be explained by the interparticle force induced by an applied magnetic field. Most MR fluids have solid particles that are magnetizable powders iron, steel, nickel, cobalt, ferrites and garnets having particles sizes large enough (e.g., 0.1 to 100 micrometers) to incorporate a multiplicity of magnetic domains. As a result, the particles possess little or no permanent magnetic moment, but are readily magnetized by an applied magnetic field. The level of magnetic induction induced in the bulk material is characterized by its relative permeability. The relative permeability is itself a function of the applied field in non-linear materials such as those commonly used in MR applications. When an external magnetic field is applied to an initially random arrangement of magnetizable particles, a magnetic moment (roughly) parallel to the applied field is induced in each particle. The resulting force between two particles having aligned moments is attractive. The force of attraction promotes the formation of chains or more complicated networks of nearly contacting particles aligned along the direction of the field. The network of particles so formed is essentially a solid in that it can support a shear stress without flowing.

While ER and MR provide similar results, there are several advantages inherent in MR fluids as compared to ER fluids. For example, the yield stress values generated by MR fluids are significantly greater than those measured for their ER fluid counterparts. In fact, yield stress values in excess of 80 kPa are easily obtainable for MR fluids in the presence of a magnetic field. As a comparison, while yield stress values for MR fluids are typically 100 kPa, yield stresses of ER fluids are 10 kPa at best. An additional advantage of MR fluids over ER fluids exists in the ability of MR fluids to operate over a broad temperature range. MR fluids are reported to function effectively throughout the temperature range of 40 to 150° Celsius. Over this temperature range, only a small variation in the yield strength of the MR fluid is observed. Lastly, MR fluids can utilize low voltage, current-driven power supplies, which are currently available for a relatively low cost.

In addition to standard MR fluids (i.e., magnetizable particles in a non-magnetizable fluid carrier), the present invention can also make use of enhanced-MR fluids such as the one described in U.S. Pat. No. 5,549,837. An enhanced-MR fluid is one that utilizes magnetizable fluid carrier medium. The magnetizable carrier medium enhances the force between magnetizable particles and thus increases the stiffness and viscosity of the MR fluid. This increased force can allow a decrease in package size and weight of a device without reducing the generated torques or forces. The present invention contemplates the use of one or more of ER, MR and enhanced-MR fluids in projectile 14. Accordingly, the term "rheological" as used herein encompasses ER, MR and enhanced-MR fluids.

The incorporation of a rheological fluid in projectile 14 can be achieved in a variety of ways, several of which will be described herein by way of non-limiting examples. Referring now to FIG. 2, a projectile 14A could be implemented by an outer casing 140 that defines the shape of projectile 14. Sealed within casing 140 is a rheological fluid having solid particles 141 of a polarizable material mixed in a fluid carrier depicted by dashed lines 142. As used herein, the term "polarizable" refers to the material's sensitivity to the field of energy produced by generator 16. That is, the term indicates that the particle material is one that can be manipulated or aligned within the carrier fluid when subjected to the field of energy produced by generator 16. Casing 140 would typically be made from a material that is i) insensitive to the energy field produced by generator 16, ii) rigid enough to maintain its shape regardless of the state of the rheological fluid, and iii) compliant enough to allow the "rigidity" of the rheological fluid to govern the lethality of projectile 14A as will be described further below. However, casing 140 could also be made from a material that sustains the applied energy field. That is, casing 140 could be a magnetizable material when the rheological fluid is an MR fluid, or casing 140 could be a capacitive material when the rheological fluid is an ER fluid.

Another embodiment of projectile 14 is illustrated in FIG. 3 where a projectile 14B is realized by a shaped block 143 of absorbent material (defining the shape of projectile 14B) that has absorbed or been saturated with a rheological fluid. Once again, the rheological fluid has solid particles 144 of a polarizable material mixed in a fluid carrier depicted by dashed lines 145. The "rigidity" of the rheological fluid will govern the lethality of projectile 14B.

Still another embodiment of projectile 14 is illustrated in FIG. 4 where a projectile 14C is realized by a shotgun-type casing 146 containing a plurality of pellets or balls 147. For clarity of illustration, only three balls 147 are shown. However, it is to be understood that more of balls 147 can be used, and that they can be sized like a standard shotgun pellet without departing from the scope of the present invention. Each of pellets or balls 147 is constructed similar to projectile 14A. That is, each pellet or ball 147 has an outer casing 148 (i.e., analogous to casing 140) filled with a rheological fluid having solid particles 149 in a fluid carrier 150 (i.e., analogous to particles 141/fluid carrier 142).

Regardless of the construction of projectile 14, the present invention provides for adjustment of the lethality thereof in the following manner. Referring now to FIG. 5, energy field generator 16 is shown with its generated energy field represented by lines 160. Field 160 represents either an electric potential field or a magnetic field depending on the type of rheological fluid incorporated in the projectile. With the projectile immersed in field 160, the solid particles in the rheological fluid align themselves parallel to field 160. Typically, the projectile is positioned relative to field 160 such that the projectile's normal direction of travel/impact is aligned parallel to field 160. For example, if the projectile is projectile 14A described above, particles 141 align themselves along the length of projectile 14A as shown thereby increasing the viscosity of the rheological fluid. The increased viscosity increases the lethality of projectile 14A. In general, the alignment of particles 141 will be maintained for several seconds even after projectile 14A is removed (e.g., fired) from field 160. Thus, projectile 14A can be constructed such that it is non-lethal if field 160 is never applied thereto or lethal if field 160 is applied thereto just prior to the firing thereof.

Figure 6:
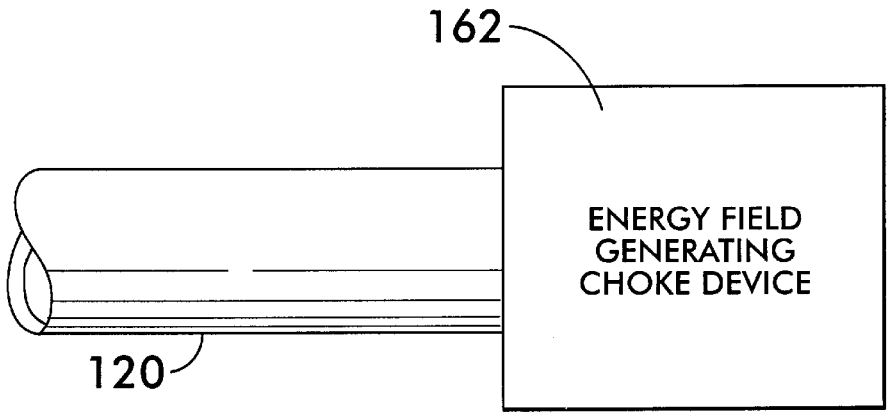
FIG. 6 is a schematic view of one embodiment of an energy field generator in the form of a choke device fitted to the end of a launch device's barrel.

Since the projectile need only be immersed in the energy field for as little as one millisecond, generator 16 can be implemented in a variety of ways. For example, as illustrated in FIG. 6, the energy field generator can be embodied in an energy-field-generating choke device 162 coupled to the end of the launch device's barrel 120. Choke device 162 generates the required energy field through which the projectile passes during firing. If the projectile incorporates an ER fluid, choke device 162 is essentially a pair of spaced-apart energized electrodes between which the projectile passes. If the projectile incorporates an MR or enhanced-MR fluid, choke device 162 is essentially a permanent or electromagnet generating a magnetic field through which the projectile passes.

If there is insufficient time for the rheological fluid to change viscosity during the time it passes through choke device 162, the present invention could also be realized by placing energy field generator 16 in a position that permits a longer dwell time in the produced field. Therefore, as mentioned above, generator 16 could provide its field all along the launch device's barrel, at the breech end of the launch device if the projectile is designed to be chambered there, or around a magazine holding a plurality of the projectiles.

The advantages of the present invention are numerous. A new class of weapon system provides the ability to vary the lethality of the projectile being fired therefrom. Further, a new class of projectile is disclosed that can be non-lethal or lethal in nature. The present invention can utilize available ER, MR or enhanced-MR fluids in a variety of projectile structures. Thus, the present invention can be adapted to work in a broad variety of non-lethal and lethal weapon operations. The lethality of the projectile is continuously variable since lethality is related to the strength of the applied energy field.

Although the invention has been described relative to a specific embodiment thereof, there are numerous variations and modifications that will be readily apparent to those skilled in the art in light of the above teachings. For example, a single projectile could incorporate both ER and MR fluids where the viscosity of one or both is increased prior to the firing thereof. Construction of the projectile could be such that: i) the application of no energy fields maintains the projectile in its most non-lethal state, ii) the application of one type of energy field places the projectile in a more lethal state, and iii) the application of both types of energy fields places the projectile in its most lethal state. It is therefore to be understood that, within the scope of the appended claims, the invention may be practiced other than as specifically described.

What is claimed as new and desired to be secured by Letters Patent of the United States is:

1. A weapon system comprising:

a projectile incorporating a rheological fluid;

a launching device for firing said projectile, wherein a direction of travel is defined for said projectile; and means coupled to said launching device for generating a field of energy about said projectile as said projectile is fired from said launching device, wherein viscosity of said rheological fluid is increased along said direction of travel to control lethality of said projectile.

2. A weapon system as in claim 1 wherein said projectile comprises a compliant outer casing sealing said rheological fluid therein.

3. A weapon system as in claim 1 wherein said projectile comprises a compliant absorptive material with said rheological fluid being absorbed therein.

4. A weapon system as in claim 1 wherein said rheological fluid is an electro-rheological fluid.

5. A weapon system as in claim 4 wherein said means generates an electric field as said field of energy.

6. A weapon system as in claim 1 wherein said rheological fluid is a magneto-rheological fluid.

7. A weapon system as in claim 6 wherein said means generates a magnetic field as said field of energy.

8. A weapon system as in claim 6 wherein said magneto-rheological fluid comprises:

a magnetizable fluid; and magnetizable particles mixed in said magnetizable fluid.

9. A weapon system as in claim 1 wherein said launching device is a gun.

10. A weapon system comprising:

a projectile incorporating a rheological fluid having particles of a polarizable material mixed in a carrier;

a launching device for firing said projectile, wherein a direction of travel is defined for said projectile; and means coupled to said launching device for generating a field of energy capable of manipulating said particles in said carrier, said means positioned to immerse said projectile in said field of energy as said projectile is fired from said launching device such that said particles align themselves within said carrier in a way that increases viscosity of said rheological fluid along said direction of travel to control lethality of said projectile.

11. A weapon system as in claim 10 wherein said projectile comprises a compliant outer casing sealing said rheological fluid therein.

12. A weapon system as in claim 10 wherein said projectile comprises a compliant absorptive material with said rheological fluid being absorbed therein.

13. A weapon system as in claim 10 wherein said rheological fluid is an electro-rheological fluid.

14. A weapon system as in claim 13 wherein said means generates an electric field as said field of energy.

15. A weapon system as in claim 10 wherein said rheological fluid is a magneto-rheological fluid.

16. A weapon system as in claim 15 wherein said means generates a magnetic field as said field of energy.

17. A weapon system as in claim 10 wherein said carrier comprises a magnetizable fluid and said particles comprise magnetizable particles.

18. A weapon system as in claim 10 wherein said launching device is a gun.

19. A variable lethality projectile for firing from a weapon comprising:

a housing defining a shape for a projectile having a length; and a rheological fluid contained within said housing, said rheological fluid having a viscosity that is increased along said length in the presence of a field of energy applied about said housing as said housing is fired from the weapon along a direction of travel that is parallel to said length wherein lethality of said projectile is controlled.

20. A projectile as in claim 19 wherein said housing comprises a compliant outer casing sealing said rheological fluid therein.

21. A projectile as in claim 19 wherein said housing comprises a compliant absorptive material with said rheological fluid being absorbed therein.

22. A projectile as in claim 19 wherein said rheological fluid is an electro-rheological fluid.

23. A projectile as in claim 19 wherein said rheological fluid is a magneto-rheological fluid.

24. A projectile as in claim 23 wherein said magneto-rheological fluid comprises:

a magnetizable fluid; and magnetizable particles mixed in said magnetizable fluid.

25. A variable lethality projectile for firing from a weapon comprising:

a housing defining a shape for a projectile having a length; and a rheological fluid contained within said housing, said rheological fluid having particles of a polarizable material mixed in a carrier, wherein said particles can be manipulated in the presence of a field of energy to increase viscosity of said rheological fluid along said length as said housing is fired from the weapon along a direction of travel that is parallel to said length wherein lethality of said projectile is controlled.

26. A projectile as in claim 25 wherein said housing comprises a compliant outer casing sealing said rheological fluid therein.

27. A projectile as in claim 25 wherein said housing comprises a compliant absorptive material with said rheological fluid being absorbed therein.

28. A projectile as in claim 25 wherein said rheological fluid is an electro-rheological fluid.

29. A projectile as in claim 25 wherein said rheological fluid is a magneto-rheological fluid.

30. A projectile as in claim 25 wherein said carrier comprises a magnetizable fluid and said particles comprise magnetizable particles.

31. A method of changing the lethality of a projectile, comprising the steps of:

providing a projectile incorporating a rheological fluid, said projectile having a length; and immersing said projectile in a field of energy that increases viscosity of said rheological fluid as said projectile is fired from said launching device along a direction of travel that is parallel to said length, wherein lethality of said projectile is controlled.

32. A method according to claim 31 further comprising the step of sealing said rheological fluid in a compliant outer casing that defines a shape of said projectile.

33. A method according to claim 31 further comprising the step of absorbing said rheological fluid with a compliant absorptive material that defines a shape of said projectile.

34. A method according to claim 31 wherein said rheological fluid is an electro-rheological fluid, and wherein said step of immersing includes the step of generating an electric field as said field of energy.

35. A method according to claim 31 wherein said rheological fluid is a magneto-rheological fluid, and wherein said step of immersing includes the step of generating a magnetic field as said field of energy.

* * * * *